United States Patent [19]

Ohashi et al.

[11] 4,371,767

[45] Feb. 1, 1983

[54] SMALL-SIZED SWITCH

[75] Inventors: Shigeo Ohashi; Hiroyuki Suga, both of Tokyo, Japan

[73] Assignee: Nihon Kaiheiki Kogyo Kabushiki Kaisha, Tokyo, Japan

[21] Appl. No.: 219,774

[22] Filed: Dec. 23, 1980

[30] Foreign Application Priority Data

Dec. 31, 1979 [JP] Japan ..... 54-182245[U]

[51] Int. Cl.[3] ..... H01H 21/12; H01H 21/30

[52] U.S. Cl. ..... 200/335; 200/291; 200/293; 200/254; 200/275

[58] Field of Search ..... 200/676, 68, 252, 254, 200/255, 260, 275, 282, 284, 163, 335, 339, 291, 293

[56] References Cited

U.S. PATENT DOCUMENTS

| | | | |
|---|---|---|---|
| 2,438,510 | 3/1948 | McLarn | 200/254 |
| 3,501,599 | 3/1970 | Horecky | 200/339 |
| 3,546,402 | 12/1970 | Spaeth | 200/275 |
| 3,641,291 | 2/1972 | Carling | 200/335 |
| 3,912,887 | 10/1975 | Gratz et al. | 200/291 |
| 4,075,442 | 2/1978 | Fukuda et al. | 200/291 |
| 4,145,586 | 3/1979 | Swann | 200/68 |
| 4,152,565 | 5/1979 | Rose | 200/291 |

*Primary Examiner*—John W. Shepperd
*Attorney, Agent, or Firm*—Lawrence I. Field

[57] ABSTRACT

Herein disclosed is a small-sized switch of the type, in which a clip-shaped moving contact made coactive with a knob is selectively and simultaneously brought, by operating the knob, into sliding contact with both the outer sides of at least two of a plurality of fixed contacts arranged in the bottom of a switch body, thus effecting the switch changing operations. The small-sized switch has its plural fixed contacts made of a round wire.

3 Claims, 8 Drawing Figures

SMALL-SIZED SWITCH

BACKGROUND OF THE INVENTION

The present invention relates to a small-sized switch, and more particularly to improvements mainly in the contacting mechanism of the small-sized switch.

According to the prior art, in the switch of the type in which a clip-shaped moving contact is laid astride and in contact with the both sides of a plurality of fixed contacts arranged in a straight line, those fixed contacts are formed, as shown in FIG. 4 (showing an example of a slide switch), into such a plate shape (which is indicated at reference numeral 5) as is made by punching a plate.

However, the plate-shaped fixed contacts raise a problem, as is experienced in a rotary switch, for example, even in the case of a mechanism of the type in which a clip-shaped moving contact is brought into contact with a single fixed contact. Especially in case the moving contact has to be brought into simultaneous contact with two fixed contacts, as in a switch to which the present invention is to be applied, the following problems are further raised. More specifically, even if those plural fixed contacts are arranged in a row in the switch base plate, the corners (or the edge portions) of the fixed contacts act, when in the operation of the switch, i.e., when the clip-shaped moving contact is to move, to scrape the silver or the like plated on the inner sides of the aforementioned moving contact. The resultant problem is that the contacting stability is deteriorated. When those aligned fixed contacts are to be caulked to the base plate, moreover, there arises another problem that the leading end portions of the fixed contacts are inclined or slightly bent. If those fixed contacts are assembled, as shown in FIG. 5(*a*), the plural fixed contacts 5, 5' and 6 are not aligned but meandered. In this instance, therefore, if the clip-shaped moving contact 7 is made to clip the two fixed contacts for the switching operations, there arises a phenomenon that the moving contact abuts, in its moving course, against the near sides of the adjoining fixed contacts so that its sliding movement is blocked. As is better seen from FIG. 5(*a*), on the other hand, the moving contact 7 moves along one side of each fixed contact or pushes one of the fixed contacts thereby to invite another phenomenon that it absolutely fails to contact with one side of the other eccentric or bent fixed contact 5. On the other hand, since the conventional plate-shaped fixed contacts are generally formed by the punching process using a press, their respective one sides are formed with burrs so that they have high frictional resistances. Those phenomena cause that the contacting state of the moving contact with the fixed contacts is effected only at one side or at a point so that it remarkably lacks smoothness or becomes imperfect or unstable. The contacting area of the contact is so considerably reduced that the rated current capacity is not allowed to invite an accident due to the heat liberation. Likewise, an accidental insufficiency in the contacting state is invited to raise another drawback that the durability of the contacting portions is remarkably reduced.

In the conventional switch, moreover, since the plate-shaped fixed contacts 5, 5' and 6 are widthwise arranged in a row, as shown in FIG. 4, the spacing between the respective fixed contacts cannot be reduced so much as to invite difficulty in the reduction of the switch size.

SUMMARY OF THE INVENTION

The present invention has been conceived in view of the aforementioned background concomitant with the prior art. It is therefore an object of the present invention to provide a novel small-sized switch which can eliminate the aforementioned drawbacks of the prior art.

Another object of the present invention is to provide a novel small-sized switch which has its contacting mechanism made smoothly operable and which can be constructed in a remarkably small size and at a low cost.

The aforementioned objects of the present invention can be achieved by providing a small-sized switch of the type, in which a plurality of fixed contacts are arranged in a switch base plate and in which a moving contact made of an elastic plate is selectively brought into sliding contact with those fixed contacts thereby to effect the switching operations, wherein the improvement resides in that the aforementioned respective fixed contacts are made of a conductive wire having a round cross-section and in that a clip-shaped moving contact attached to a knob or a converter is simultaneously brought into contact with the rounded outer sides of the aforementioned plural fixed contacts.

According to the aforementioned construction of the present invention, since the fixed contacts are made of a round wire, the contacting state is made, even if the fixed contacts are arranged more or less eccentrically, between the two rounds sides of the two fixed contacts and the flat sides of the moving contact thereby to remarkably reduce the frictional resistance inbetween so that neither the spare force nor the action to scrape the inner sides of the clip-shaped moving contact are applied to the moving contact thereby make the contacting actions smooth and stable, whereby the aforementioned difficulties concomitant with the prior art, such as, the insufficient contacting state, the heat liberation or the difficulty that the inner sides of the moving contact is caught by the sides of the fixed contacts so that the moving contact cannot move.

According to the present invention, moreover, since the fixed contacts can be made of a slender round rod, it is possible to realize a switch having its size remarkably reduced.

DESCRIPTION OF THE PREFERRED EMBODIMENTS

The present invention will be concretely described in the following in connection with the preferred embodiments thereof with reference to the accompanying drawings.

Figure 1:
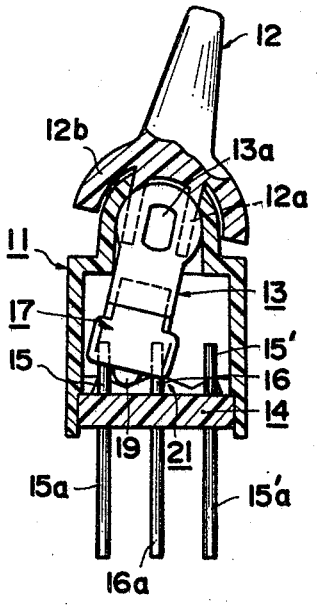
FIG. 1 is a partially sectional view showing the internal construction of one embodiment of the small-sized switch according to the present invention.
Figure 2:
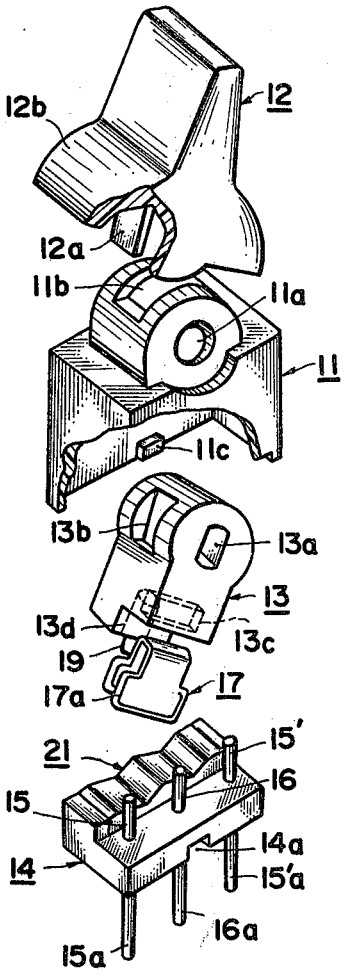
FIG. 2 is an exploded perspective view showing the embodiment of the small-sized switch according to the present invention.
Figure 3:
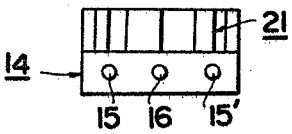
FIG. 3 is a top plan view showing a switch base plate to be used in the embodiment of the small-sized switch according to the present invention.
Figure 4:
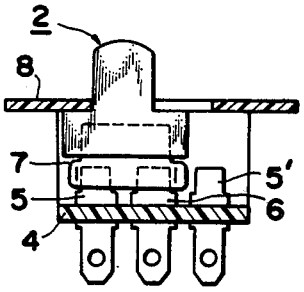
FIG. 4 PRIOR ART
FIG. 4 is a partially sectional view showing the internal construction of the slide switch according to the prior art.
Figures 5A, 5B:
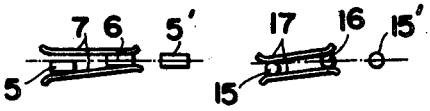
FIG.5a FIG.5b PRIOR ART
FIGS. 5(*a*) and 5(*b*) are diagrammatical views showing the contacting states between the moving contact and the fixed contacts of the plate-shaped type according to the prior art and the round rod-shaped type according to the present invention, respectively, in case one or more of the plural fixed contacts have their leading ends bent eccentric.

FIGS. 1, 2 and 3 are a partially sectional, an exploded perspective view showing one embodiment of the small-sized switch according to the present invention, and a top plan view of a switch base plate, respectively. The embodiment to be described corresponds to the example in which the present invention is applied to a rocker type switch. Indicated at reference numeral 11 in FIGS. 1 and 2 is a switch body, which is formed with a hole 11*a* and an opening 11*b*. The hole 11*a* is positioned at those facing sides of the upwardly bulging portion of said switch body 11, which are substantially at a right angle with respect to the direction of the switching actions (or operations) such that they receive a pin (which is not shown in the drawing but can be dispensed with in the present invention from the later-described reason). On the other hand, the opening 11*b* is positioned in the upper surface of the upwardly bulging portion of said switch body 11 and receives the leg member 12*a* of a knob 12. Numeral 13 indicates a converter, which is formed with a through hole 13*a* at its bulging portion corresponding to the hole 11*a* of the aforementioned switch body 11. The through hole 13*a* is adapted to receive the aforementioned pin through the hole 11*a*. The knob 12 is removably fitted in the converter 13 through the upwardly bulging portion of the switch body 11 by having its leg member 12*a* engaging with the recess 13*b* which is formed in the side of the bulging portion of the converter 13. If the knob 12 is jointed to the converter 13, the bulging portion 12*b* of the knob has its lower side in sliding engagement with the upper side of the aforementioned bulging portion of the switch body 11, while being supported thereby, to effect the switching operations. Therefore, the aforementioned pin can be dispensed with. In this particular instance, the hole 11*a* of the switch body and the through hole 13*a* of the converter can be likewise dispensed with. In the embodiment as shown, the knob used has a lever shape, but it is needless to say that the knob 12 can be replaced by the knob of a corrugated switch or the like. In the present embodiment, moreover, although the knob 12 and the converter 13 are constructed separately of each other, they can be made integral by having their shape or construction slightly modified. Still moreover, in place of the construction that the knob 12 and the converter 13 are jointed by having their leg member 12*a* and recess 13*b* engaging with each other, they may be jointed partly by forming a similarly track-shaped hole in that side of the knob 12, which corresponds to the through hole 13*a* of the converter, and partly by fitting a track-shaped (not-shown) pin in the hole and the through hole 13*a*.

To the lower portion of the switch body 11, there is fixed a switch base plate 14 by having the protrusion 11*c* of the former and the recess 14*a* of the latter engaging with each other. At the base plate 14, moreover, there are anchored a plurality of (or three in the embodiment as shown) fixed contacts 15, 15' and 16 which constitute an essential part of the present invention. These fixed contacts 15, 15' and 16 are made to have a round cross-section (wherein the round shape is intended to include circular, oval and other shapes), i.e., of a wire of a (conductive) round rod, and their portions protruding to the outside of the switch function as terminals 15*a*, 15*a'* and 16*a*, respectively. Of these, the contact 16 is used as a common fixed contact. The aforementioned converter 13 has its lower portion formed at one side with a hole 13*c*, in which a clip-shaped moving contact 17 is gently fitted. The moving contact is formed with outwardly extending ear members 17*a*, which are selectively brought into sliding contact, while being laid astride, with both sides of at least two of those fixed contacts 15, 15' and 16. The aforementioned fitting of the moving contact 17 in that hole 13*c* can be effected by means of a spring. By the hole 13*c*, incidentally, the moving contact 17 is prevented from shifting in the moving direction of the knob. As a modification, it is possible either to make the moving contact 17 with the converter 13 or to fix the contact 17 to the converter 13 by rivets.

In the embodiment having the construction thus far described according to the present invention, the converter 13 is rocked about its through hole 13*a* or on the aforementioned pin, if actually used, by tilting the knob 12 to the right and left so that the moving contact 17 attached to the lower portion thereof is selectively brought into sliding contact with the fixed contacts 15, 15' and 16. In this instance, the moving contact 17 slides to make contact with at least two of the fixed contacts. Here, since the fixed contacts 15, 15' and 16 are made of the wire (or round rod), it is naturally possible to obtain a feature that there is little loss in the production of the fixed contacts. Still the better, the surfaces of the fixed contacts 15, 15' and 16 are rounded in the sliding direction of the moving contact 17, the contacting friction and resistance is so reduced as to eliminate a phenomenon that both the sides of the moving contact are caught to stop by the sides of the fixed contacts even if the fixed contacts are more or less eccentric. In addition, since the moving contact is brought into contact with both the sides of the fixed contacts having a round or generally round cross-section, as is different from the prior art switch using the plate-shaped fixed contacts, the moving contact 17 never fails to contact with both the sides of the two fixed contacts even if the fixed contact 15, for example, is eccentric. Thanks to the roundness of the fixed contacts, moreover, there can be obtained a feature that a uniform contacting pressure is applied to the two fixed contacts. As a result, the switching operations can be achieved smoothly and reliably. In other words, the conventional switch resorts to the contact between the two flat fixed contacts and the moving contact having flat sides. In the case of the present invention, on the contrary, the contact is effected between the two fixed contacts having round sides and the moving contact having flat sides. Because of the difference, according to the present invention, it is possible to provide a switch which the stable contact changing actions, as has been described in the above.

Moreover, since a wire is used as the material of the fixed contacts, it is possible to realize the small-sized fixed contacts having their widths minimized. As a result, the spacing between the fixed terminals can be shortened to invite another feature that the switch can have its size further reduced.

Still moreover, even if the fixed contacts according to the present invention are made thin, the moving contact contacts under a stable contacting pressure with both the sides of the fixed contacts thereby to naturally stabilize the contacting resistance. It is also possible to attain a further feature of providing a switch has a current capacity equal to or higher than that of such a conventional switch as is equipped with fixed contacts having a contacting area two times as large as or more than that of the plate-shaped fixed contacts according to the prior art.

Reverting to FIGS. 1 to 3, a slider 19 is slidably fitted through a (not-shown) spring in the hole 13*d* which is formed in the other side of the lower portion of the converter 13. On the other hand, a corrugated cam plate 21, on which the aforementioned slider 19 slides back and forth during the switch changing operations, is mounted on the switch base plate 14 in parallel with the plural fixed contacts. That cam plate 21 is provided for clarifying the feelings of the turning the switch on and off, in other words, for improving the sharpness of the switching operations. In case there is no pin fitted in the converter 13, since a slightly upward force is applied to the converter 13 by the actions of the spring between the hole 13*d* of the converter and the slider 19 and/or the spring (if any) between the hole 13*c* and the moving contact 17, a preferable effect for the switching operations can be obtained.

The switch according to the present invention, as shown, is of the type in which it takes its stop positions at the right and left by the action of the cam plate 21. If this cam plate is made replaceably removable, the switch having positions ON and ON (or OFF) can be changed into a three-position switch having positions ON, OFF and ON merely by replacing that cam plate by a cam plate having a recessed center portion without changing the moving contact. In addition, it is also possible to provide the so-called "momentary type switch", in which the knob automatically restores its initial position if it is tilted and released. Moreover, it is sufficient to simply place the cam plate 21 upon the switch base plate 14 because it is always biased by the slider 19. However, it is more sufficient to sideway fit the cam plate, as shown. Incidentally, it is needless to say that the cam plate can be made integral with the switch base plate.

Although the foregoing description of the aforementioned embodiment is made on the switch which is operated by tilting the knob, the present invention can naturally be applied in a similar manner to the slide switch which is operated by sliding the knob.

Figure 6:
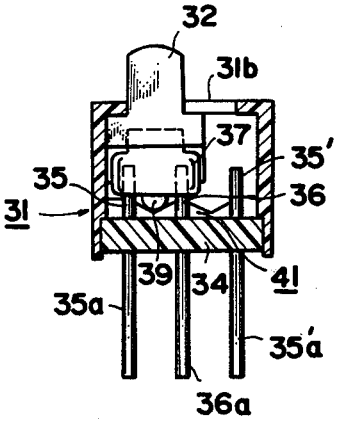
FIG. 6 is a partially sectional view showing the internal construction of another embodiment of the small-sized switch according to the present invention.
Figure 7:
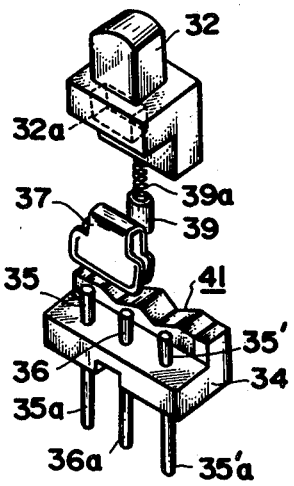
FIG. 7 is a partially exploded perspective view showing the another embodiment of the present invention.

FIGS. 6 and 7 are a sectional view and a perspective view showing another embodiment of the present invention in case the present invention is applied to the above slide switch. With reference to FIGS. 6 and 7, there is disposed in a switch body 31 a knob 32 which is adapted to slide along an opening 31*b* formed in the upper portion of the switch body 31. At a switch base plate 34 disposed in the lower portion of the switch body 31, there are anchored a plurality of fixed contacts 35, 35' and 36 which constitute an essential part of the present invention (of which the fixed contact 36 is used as a common fixed contact). Those fixed contacts 35, 35' and 36 are made similarly to the foregoing embodiment to have a round or oval shape, i.e., of a wire of a single (conductive) round rod, and their portions protruding to the outside of the switch function as terminals 35*a*, 35*a'* and 36*a*, respectively. In the hole 32*a* formed in one side of the lower portion of the knob 32, there is fitted either directly or through a spring a clip-shaped moving contact 37 which is selectively brought into sliding contact, while being laid astride, with both the sides of at least two of the fixed contacts 35, 35' and 36. As is different from the aforementioned embodiment using the converter 13, according to the present invention, the moving contact 37 is connected directly to the knob 32 so that this knob 32 can be said to take the function of the converter. In the other side of the lower portion of the knob 32, there is slidably fitted through a spring 39*a* a slider 39, which is adapted to slide on the corrugated cam surface of such a cam plate 41 as is either fixed to or removably mounted on the switch base plate 34 thereby to ensure the switch snapping actions, whereby the switch changing feeling can be obtained.

If, in operation, the knob 32 is slid along the opening 31*b*, the moving contact 37 is brought by the knob 32 selectively into sliding contact with the outer sides of the fixed contacts 35, 35' and 36 thereby to effect the switch changing operations. The remaining functions and effects are substantially similar to those of the aforementioned embodiment.

According to the present invention having the constructions thus far described, the contacting surfaces are owned by the round rods and the plate so that neither spare force nor the action for scraping the inner sides of the clip-shaped moving contact are applied to the moving contact. As a result, the sliding contact of the contacting mechanism is accomplished smoothly, stably and reliably. Moreover, since the fixed contacts can be made of a thin round rod, it is possible to realize a switch which can have its size remarkably reduced.

Although the present invention has been described as to the preferred embodiments thereof, these embodiments are merely exemplary, and the present invention should not be limited to those embodiments but have its scope extending to cover all the small-sized switches which are equipped with fixed contacts made of a wire having a round cross-section.

What is claimed is:

1. A small-sized switch comprising:

a switch body having a main hollow side portion and an upper portion, a converter disposed within said switch body at its hollow side portion and slidably engaged with the inner surface of said upper portion of said switch body, said converter provided with a clip-shaped moving contact of an inverted U-shaped form and a spring biased slider, a knob removaly connected to said converter through the opening of said upper portion of said switch body so that said converter is operable by said knob, and a base plate adapted to be fitted in said switch body at its hollow side portion, said base plate being integrally provided with a cam plate for engaging with said slider to spring bias said converter toward said inner surface of said upper portion and having a plurality of fixed contacts each made of a wire in a round cross section anchored, said moving contact adapted to be selectively and simultaneously brought into sliding contact with at least two adjacent fixed contacts of said plurality of fixed contacts to thereby effect switching operations.

2. A switch as set forth in claim 1 wherein said upper portion of said switch body is of a hollow semi-cylindrical form and said slidably engaged portion of said converter is of a substantially semi-cylindrical form whereby said converter is slidably swung relative to said switch body by said knob.

3. A switch as set forth in claim 1 wherein said cam plate of said base plate is arranged in parallel with said fixed contacts, said cam plate has recesses for imparting stable positions to said converter, said recesses being flush with each other and said fixed contacts inwardly project at the same height.

* * * * *